United States Patent [19]

Fazan

[11] Patent Number: 4,715,205

[45] Date of Patent: Dec. 29, 1987

[54] PLANETARY-TYPE ROLLING MILL FOR NON-FLAT PRODUCTS

[75] Inventor: Bernard Fazan, Metz, France

[73] Assignee: IRSID, Saint Germain-en-Laye, France

[21] Appl. No.: 892,457

[22] Filed: Aug. 4, 1986

Related U.S. Application Data

[63] Continuation of Ser. No. 704,226, Feb. 22, 1985, abandoned.

[30] Foreign Application Priority Data

Feb. 22, 1984 [FR] France ..... 84 02803

[51] Int. Cl.[4] ..... B21B 13/20

[52] U.S. Cl. ..... 72/198; 72/191

[58] Field of Search ..... 72/190, 191, 194, 197, 72/198, 240, 235, 406

[56] References Cited

U.S. PATENT DOCUMENTS

| | | | |
|---|---|---|---|
| 3,557,593 | 1/1971 | Bollig et al. | 72/190 |
| 3,643,488 | 2/1972 | Bretschneider | 72/191 |
| 4,193,282 | 3/1980 | Wilson | 72/197 |

*Primary Examiner*—Lowell A. Larson

*Attorney, Agent, or Firm*—Pollock, Vande Sande & Priddy

[57] ABSTRACT

In this rolling mill, a rolling action is brought about by work rolls acting as opposing pairs arranged equiangularly at the periphery of rotating rolling units distributed symmetrically about the material to be rolled. The axes (10') of the work rolls (10, 11) are parallel with the axis (40) of the rotating unit that carries them, and each work roll (10) is a solid of revolution consisting of two truncated cones (12, 13) axially joined by their equal minor bases and forming a rounded "waist" in the plane V perpendicular to the axis (10') of the work rolls. The invention is applicable to non-flat metal products whatever their cross-sectional shape. With quadrangular products, the invention assures well-finished radius corners with no chance of twisting.

2 Claims, 19 Drawing Figures

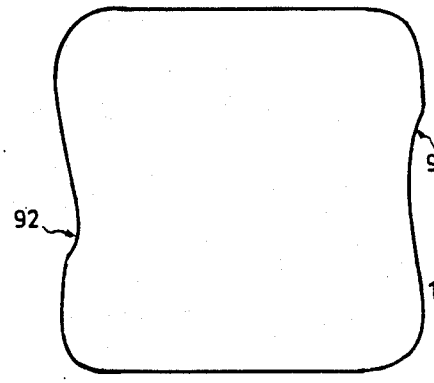
Fig. 9
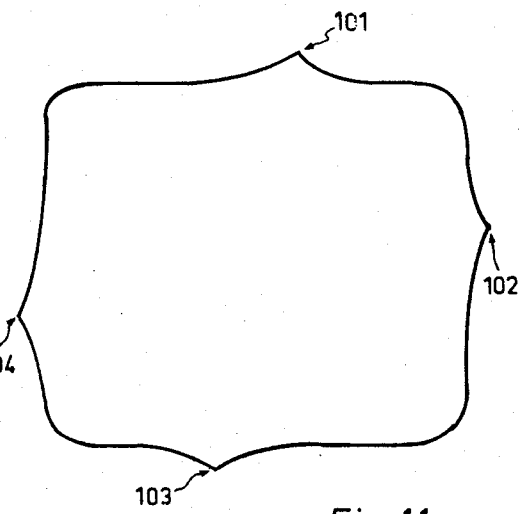
Fig. 11
Fig. 10
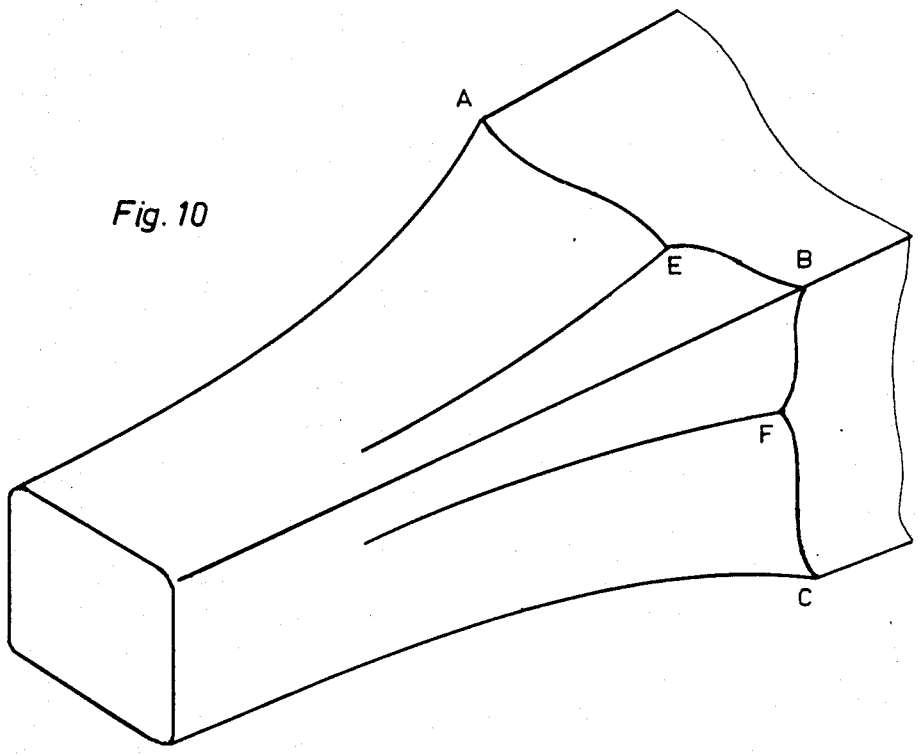

PLANETARY-TYPE ROLLING MILL FOR NON-FLAT PRODUCTS

This application is a continuation, of application Ser. No. 704,226, filed Feb. 22, 1985 now abandoned.

FIELD OF THE INVENTION

This invention relates to universal planetary-type rolling units for rolling non-flat products, such as steel billets.

Rolling mills of the type considered herein include paired symmetrical rolling units, each fitted with work rolls evenly distributed along the periphery.

These rolling units may be of two types, including a first type in which the work rolls run on a back-up roll and whose trunnions are mounted on bushings held in a cage and rotating concentrically with the back-up roll, such a unit being known as the "back-up roll and cage type," and a second type, without back-up roll, in which the work roll trunnions are mounted directly into a rotating carrier and, hence, known as the "rotating-carrier type."

In both types, the work rolls of each unit must move in synchronism with the other units so that the rolling operation may be performed by the work rolls coming successively into contact with the material to be rolled.

In the description to follow, only the rotating-carrier type will be dealt with, it being understood that the invention applies equally well to the back-up roll and cage type.

In addition, for the sake of simplicity, the description will deal with the rolling of a square cross-sectional billet contacted by the work rolls of four rotating carriers whose axes lie in the same plane and which arranged opposite each face of the billet.

BACKGROUND OF THE INVENTION

Referring to the state of the art, FIG. 1*a* shows the principle of a universal planetary rolling as suggested in 1962 by Tselikov. In this system, a small square cross-sectional billet 1 is subjected to the joint action of two sets of work rolls. The first set is integral with two rotating carriers 2 and 2' which are synchronously driven rotationally about parallel axes 3 and 3'. The rotating carrier 2 carries a set of work rolls 4*a*, 4*b*, . . . 4*n*, distributed equiangularly along the periphery, and the rotating carrier 2' carries an identical set of work rolls 4*a'*, 4*b'*, . . . 4*n'* arranged to oppose the first set of work rolls, the axes of all work rolls being parallel with axes 3 and 3' of the rotating carriers. The second set of work rolls is integral with the two other rotating carriers 5 and 5', which are identical with the former and angularly offset through 90° about the axis of billet 1–1'. The rotating carriers which are ahead and behind the plane of the figure are shown, for the sake of clarity, in thin dashed lines. Work roll 6 and 6', borne by these rotating carriers, are the same in number and layout as work rolls 4 and 4', but so arranged that they act on the two other sides of billet 1–1' during the interval that separates the respective actions of two successive pairs of work rolls 2 and 2' belonging to the carriers, for instance, the pairs 4*a*, 4*a'* and 4*b* and 4*b'*. In this way, the cross section of billet 1 is gradually reduced through the action of opposing pairs of work rolls alternately on a pair of opposite sides, and then on the other. FIG. 1*b* shows the shape taken by the rolled bar in the part where it is in contact with the work rolls running through their respective paths. This part is called the roll gap, this term also being applicable to the portion of the bar located in this part and extending from the point where the deformation begins up to the sectional plane P' at which the cross-section of the billet has the desired dimensions and which is accordingly called "exit plane".

However, in this embodiment, the generatrix of the work rolls is straight so that the rolling operation is carried out, widening taking place freely: the ridging effect caused by the sharp corners A (FIG. 1*c*) due to the substantial superficial widening this type of deformation entails, results in significant cooling of the corners of the billet, formation of angular cracks and surface defects detrimental to the quality of the finished product.

To obviate this drawback, it has tentatively been suggested (European patent application issued under No. 0000290 in the name of Hill Engineering Company Limited) to use work rolls whose profile includes a shoulder with a rounded angle which rolls at every pass the relevent corner of the product. However, to achieve this end, the axes of the work rolls must be at a 45° angle to that of the rotating carrier which bears them; this involves a complication of the transmission system, jeopardizes the reliability of the operation and leads to substantially increased lateral space requirements for the machine.

OBJECT OF THE INVENTION

The object of the invention is to overcome these difficulties while providing a product with round edges by means of a rolling operation using a plain and compact mechanism in which the work roll axes remain parallel to those of the rotating carriers.

SUMMARY OF THE INVENTION

To this end, the purpose of the invention is a rolling mill of the universal planetary type for rolling non-flat products in which a rolling action is provided by opposing work rolls acting in pairs and arranged equiangularly along the periphery of rotating carriers symmetrically distributed around the product to be rolled. The work roll axes remain parallel with the axis of the rotating carrier which bears them and each work roll is a solid of revolution consisting of two truncated cones whose minor bases are equal and which are coaxially joined by their minor bases and forming a circular rounded "waist" within a plane perpendicular to the work roll axes.

In the specific instance of rolling square cross-sectional products, the straight portion of the generatrix of the truncated cones is at a 45° angle to the work roll axis, which is thus parallel with the diagonal of the exit section.

The rotating carriers bearing the work rolls are driven rotationally and synchronized by means known per se. Depending on the application considered, the work rolls may or may not be driven rotationally.

The shape of the final cross-section is obtained by the successive actions of opposing paired work rolls acting in two directions perpendicular to each other. During each such action, each work roll is in contact with two adjacent sides of the billet; such contact may take place either throughout the width of the billet side or only a portion of such width.

BRIEF DESCRIPTION OF THE DRAWINGS

The invention will now be described in more detail with reference to the appended drawings in which several embodiments of the invention are shown for purposes of illustration, and in which:

FIG. 9 is a schematic view of the cross-section of the billet, taken in the roll-gap, in connection with the embodiment of FIGS. 2, 3 and 4; and FIGS. 10 and 11 are schematic views, respectively in perspective and in cross-section of the billet, taken in the roll gap with respect to the embodiment of FIGS. 7 and 8.

DETAILED DESCRIPTION

Figure 2:
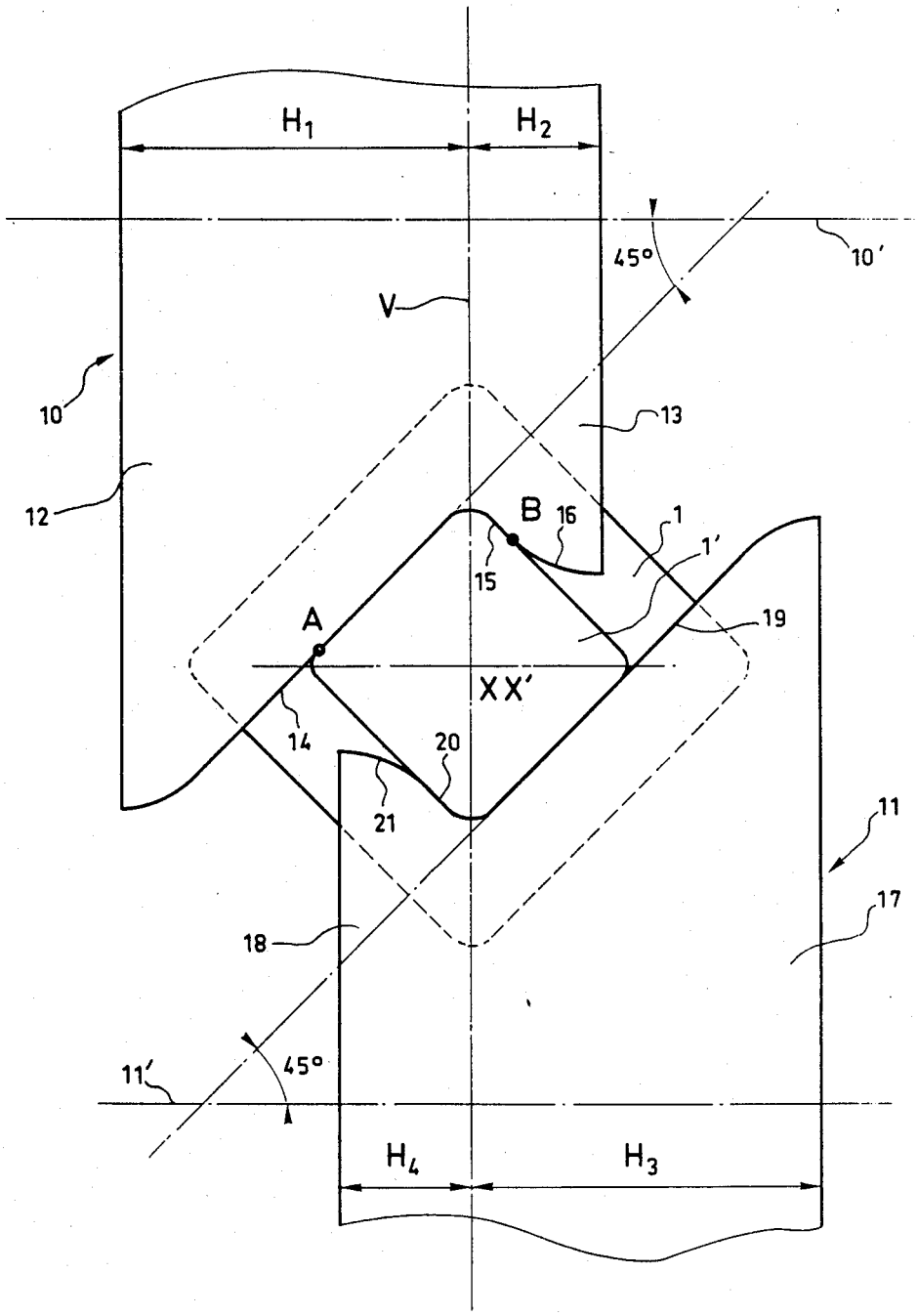
FIG. 2 illustrates an embodiment of the invention for rolling a square billet and in which the contact between one face of the work roll and their relevant side of the billet takes place throughout the width of such side.

FIG. 2 illustrates in principle the solution according to the invention which corresponds with the first of the two possibilities considered earlier, in which the contact between at least one of the faces of the work roll and the billet takes place throughout the width of the relevant side of the billet; this will be termed herein variant 1.

In this solution, the invention consists in imparting to each work roll 10 (11), rotating about its axis 10' (11') the shape of a solid of revolution derived by uniting two co-axial truncated cones 12, 13, (17, 18) of different heights joined by their minor base so as to form a circular rounded "waist" in the plane V perpendicular to the axes of the work rolls and to that of the rotating carrier bearing them and including a diagonal of the billet, the longer face of one work roll facing the longer face of the other work roll opposing it.

The straight portion of face 14 of truncated cone 12 of work roll 10 has a length sufficient for contact to take place with the relevant side of the billet throughout its width, so as to impart to this side an even and properly defined shape.

Such is not the case for the straight portion of face 20 of truncated cone 18 of work roll 11 facing it as, otherwise, the opposing work rolls 10 and 11 could strike each other during their run. The shortest face of each work roll, i.e., side 15 of work roll 10 or side 20 of work roll 11 accordingly come into contact with the relevant side of the billet on only a portion of its width. This side of the billet will therefore include a part that is rolled when work roll 10 passes over it and a part which is not; this would set up, at the boundary of both parts, a discontinuity of the deformation. To eliminate this drawback, provision is made at the end of the shortest face 15 (or 20) for an outward spreading portion 16 (respectively 21) whose purpose is to achieve a continuous transition between the rolled and unrolled parts.

The straight portion of the contours or generatrices of the faces of the truncated cones are, as mentioned earlier, at 45° to the work roll axis.

For each opposing paired work roll, one of these (for instance 11) is deducted from that matching it by a rotation through 180° about the longitudinal axis XX' of the billet that is perpendicular to the plane of FIG. 2.

In addition, in the planar system, comprising for each rotating carrier two diametrically opposed work rolls, the invention consists in inverting from one work roll to the other the layout of both truncated cones. In other words, in the work roll opposing work roll 10 on the same rotating carrier, the larger truncated cone is to the right and the smaller to the left, whereas, in the work roll opposing work roll 11 on the other rotating carrier, it is the smaller truncated cone which is to the right and the larger which is to the left. The reason for this inversion, as shown by FIG. 4, is the elimination of an eventual trend of the billet to twist about the axis XX' during the rolling process.

Likewise, in the planar system, consisting in associating with the pair of rotating carriers with horizontal axes another pair of rotating carriers with vertical axes, oriented with respect to the first pair by a rotation through 90° about the axis XX', the invention makes provision for setting on these rotating carriers with vertical axes work rolls similar in size, shape and distribution, acting as paired opposing work rolls and the contours of which are offset, for each opposing pair of work rolls, from those of the opposing pair of work rolls of the other pair of rotating carriers which preceded it in the successive rolling actions, by achieving initially a symmetry with respect to the vertical axial plane of the billet, and then a rotation of same through 90° about the axis of the billet.

To clarify these various arrangements, reference will now be made to FIGS. 3 and 4.

Figure 1A:
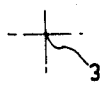
FIGS. 1*a*, *b* and *c* represent the prior art.
Figure 1B:
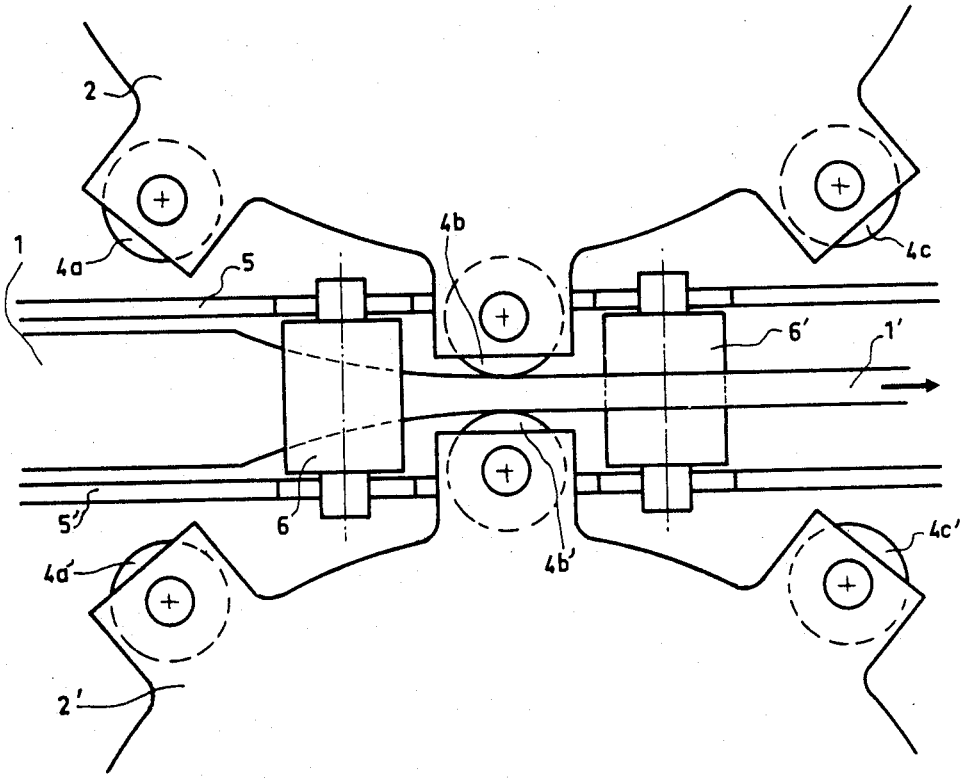
Figure 1B:
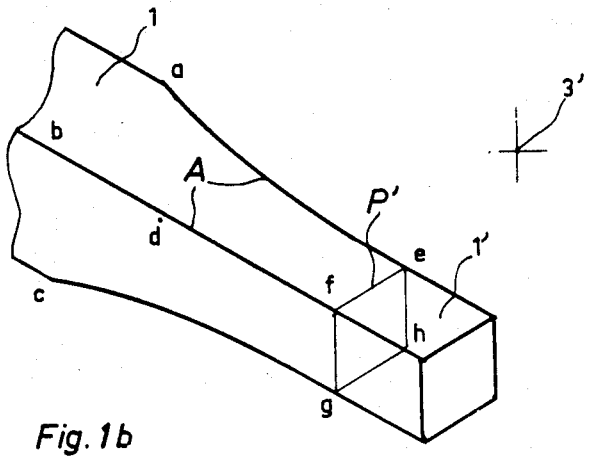
Figure 1C:
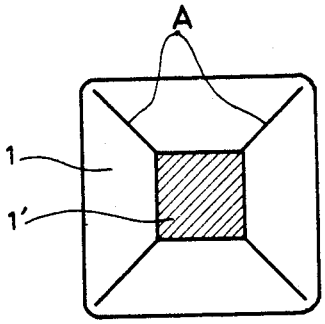
Figure 3:
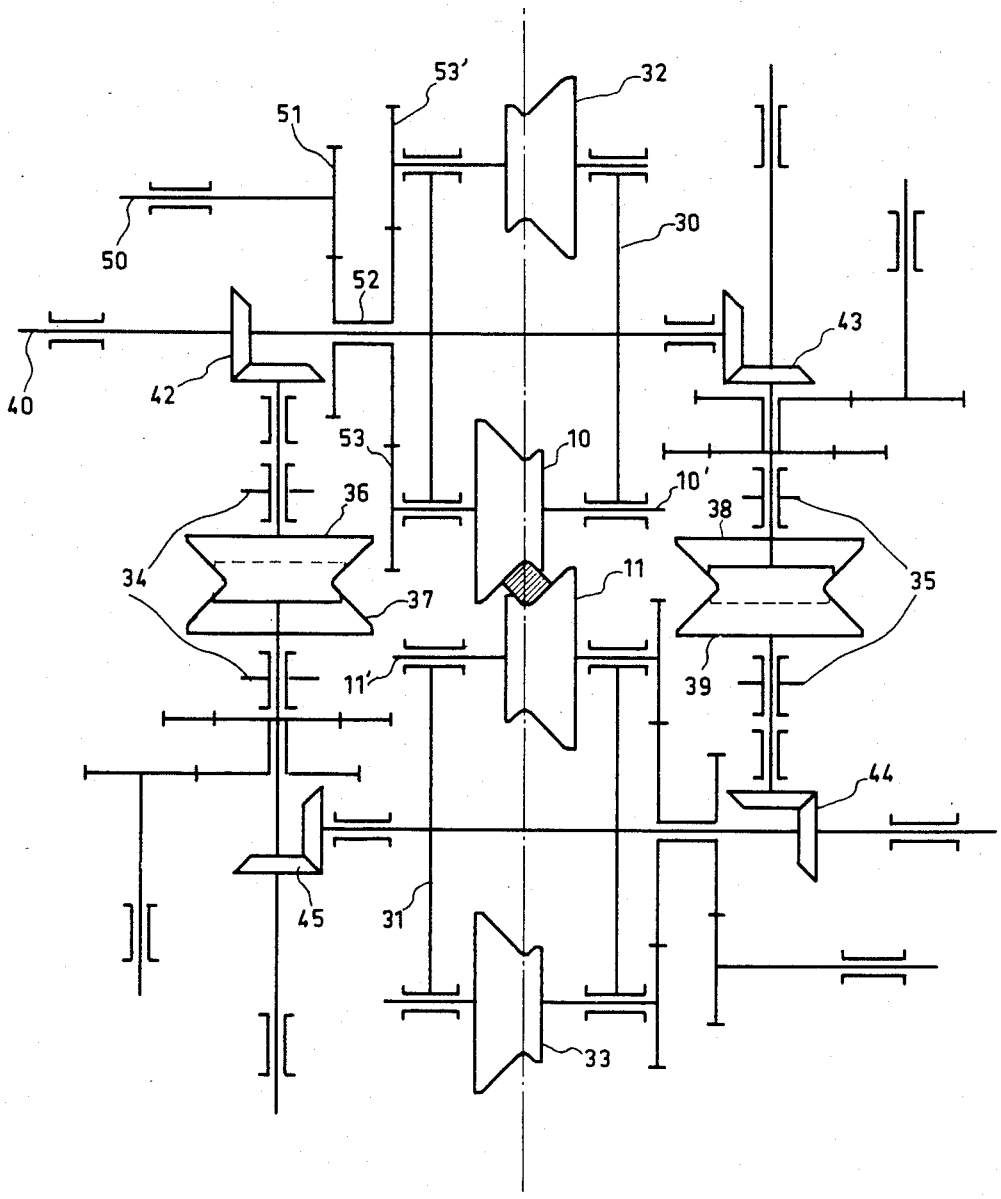
FIG. 3 is the schematic diagram of the whole system for implementing the embodiment of the invention according to FIG. 2.

In FIG. 3, which represents schematically the system as a whole, according to the invention, the paired work rolls of FIG. 2 are again shown, with the same reference marks used for the same elements, work rolls 10 and 11 rotating about axes 10' and 11' on bearings at the periphery of rotating carriers 30 and 31, bearing opposed work rolls 32 and 33, respectively. Likewise, two other rotating carriers, 34 and 35, rotating perpendicularly to the previous ones (such as 5 and 5' with respect to 2 and 2' in FIG. 1*a*), carrying paired work rolls 36–37 and 38–39 are offset through 90° with respect to work rolls 10–32 and 11–33 to ensure synchronization of the rolling process. Operation of the system is provided via transmission shafts 40 and 50 driven by motors (not shown). Shaft 40 drives the rotating carrier 30, and the speed of rotation of the rollers can be set as shown in FIG. 3, from shaft 50 via gear wheels 51, 52, 53–53'. The double gear wheel 52 turns freely on shaft 40 and synchronization of the three other rotating carriers and the work rolls they bear is provided by bevel-gear drives 42, 43, 44 and 45. Synchronization of shaft 50 with the three other similar shafts of the three rotating carriers is not shown, so as not to unduly clutter the figure. It follows that this method for setting the rotational speed of the rollers is only a non-limitative example and can be achieved by any other means known per se without exceeding the scope of the invention.

The shape of opposing paired work rolls 10–11 and 32–33 is in accordance with the particulars set forth with reference to FIG. 2.

The other two rotating-carrier/work roll assemblies 36 to 39 with vertical axes are identical within the angular offset.

Figure 4A:
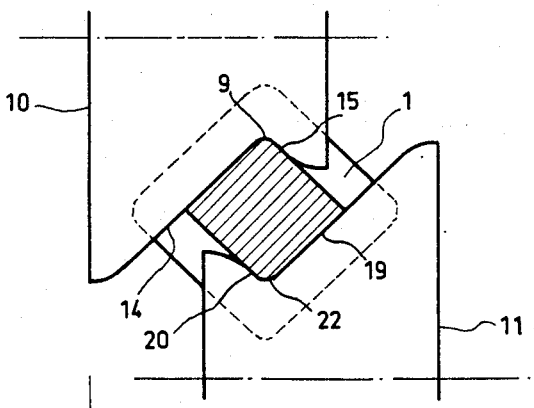
FIGS. 4*a*, 4*b*, 4*c* and 4*d* illustrate operation of the system shown in FIG. 3, detailing the various phases of a rolling operation cycle.

The assembly operates as shown in FIGS. 4*a* to 4*d*. FIG. 4*a* corresponds to the position, as a whole, of the elements shown in FIG. 3. In this instance, billet 1 is subjected to the action of work rolls 10 and 11. When the paired work rolls 10 and 11 run through the arc of contact, the faces 14 and 19 of the major truncated cones, 12 and 17, of the work rolls perform the main rolling action throughout the width of the billet sides involved in this action, whereas that of the shorter faces, 15 and 20, is restricted to only a portion of the width of the two other sides. The "waists" 9 and 22 of work rolls 10 and 11 remain in contact with the relevant corners of the billet, imparting to them the desired rounded edge.

Following a rotation of the four rotating carriers through 90°, the work rolls 36 and 38, supported by rotating carriers, with vertical axes 34 and 35, then enter into operation. The situation is then as illustrated in FIG. 4*b*, the billet being subjected to the action of work rolls 36 and 38, the longer faces, 46 and 47, of work rolls 36 and 38 performing the main action, whereas action of the shorter faces 48 and 49 takes place only on a portion of the width of the billet sides with which they are in contact, while the two other corners of the billet are rolled by the rounded "waists" of the work rolls.

Figure 4B:
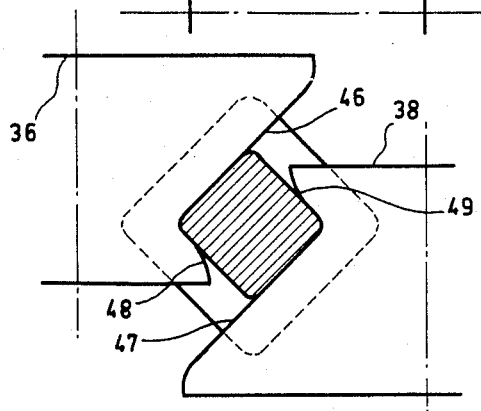
Figure 4C:
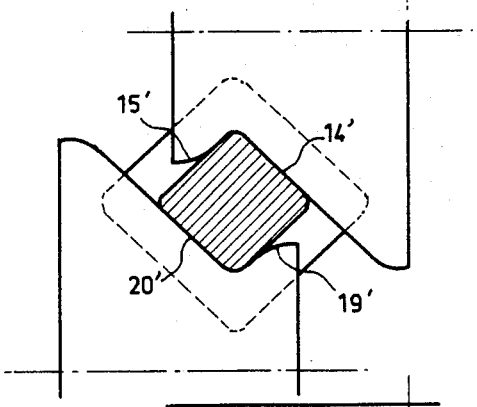

After another rotation through 90° in the same direction, the FIG. 4*c* position is reached, in which the situation is similar to that of FIG. 4*a*, but where this time the shorter faces 15' and 20' contact the billet sides which, in FIG. 4*a*, were subjected to the action of the longer faces, 14 and 19, and vice-versa.

It can be seen that the action of the longer faces 14' and 19' has, inter alia, the effect of evening the sides of the billet which, during the action of two previous passes of the opposite work rolls, shown in FIGS. 4*a* and 4*b*, were not rolled uniformly throughout their width, as will be seen in more detail hereinbelow.

Figure 4D:
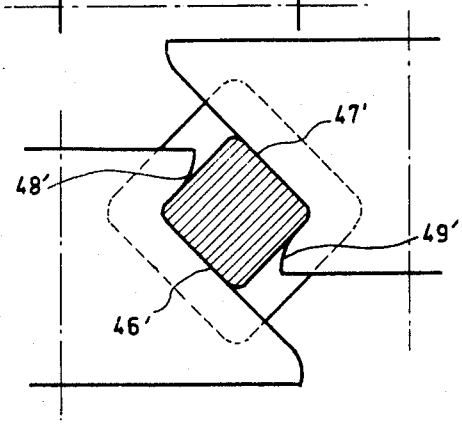
Figure 5A:
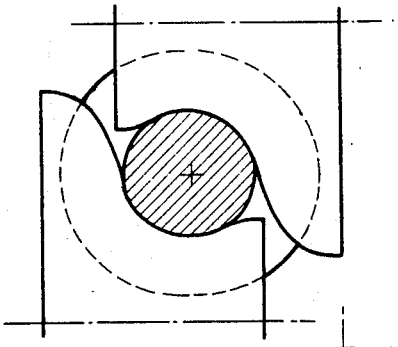
FIGS. 5*a*, 5*b*, 5*c* and 5*d* are diagrams similar to those of FIGS. 4*a*, 4*b*, 4*c* and 4*d*, but show an embodiment of the invention adapted for rolling circular cross-sectional products.
Figure 5B:
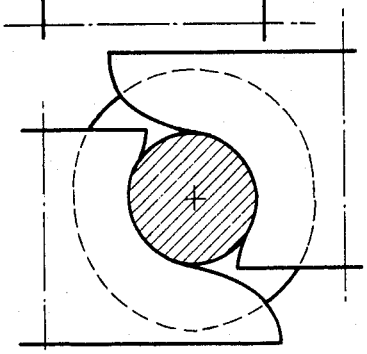
Figure 5C:
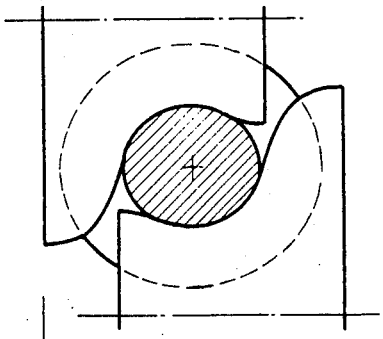
Figure 5D:
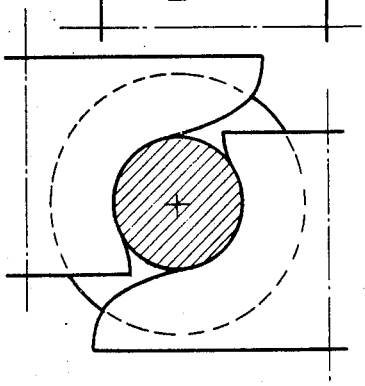

Likewise, after a third rotation through 90°, the configuration of FIG. 4*d* is reached, where the situation is similar to that of FIG. 4*b*, where the shorter faces, 48 and 49, contact the billet sides which, in FIG. 4*a*, were subjected to the action of the longer faces 46 and 47, and vice-versa.

Therefore, the asymmetrical action of the work rolls distributed along the periphery of the rotating carriers which might bring about a twisting effect on the billet occur alternately in opposite directions, so that this twisting tendency is consistently neutralized.

In the system just described, each rotating carrier comprises only two diametrically-opposed work rolls. It follows that, while remaining within the scope of the invention, it is possible to equip each rotating carrier with an integral number of successive paired work rolls, the said work rolls being individually distributed equiangularly along the periphery of each rotating carrier, both work rolls of a pair reproducing the shape and layout with respect to the billet at the time the deformation takes place as described with respect to the simpler type of system, comprising two work rolls per rotating carrier, whereas the shape and layout of the work rolls recur from one pair of work rolls to the next.

Likewise, the invention is not restricted to the rolling of square billets but extends to not-flat products the cross-section of which is circular, rectangular or polygonal.

FIGS. 5*a*, 5*b*, 5*c* and 5*d* show how a circular cross-sectional bar is rolled from a bar the initial cross-section of which, shown in dashed lines, is represented as a circular shape, but which may have another shape.

Figure 6:
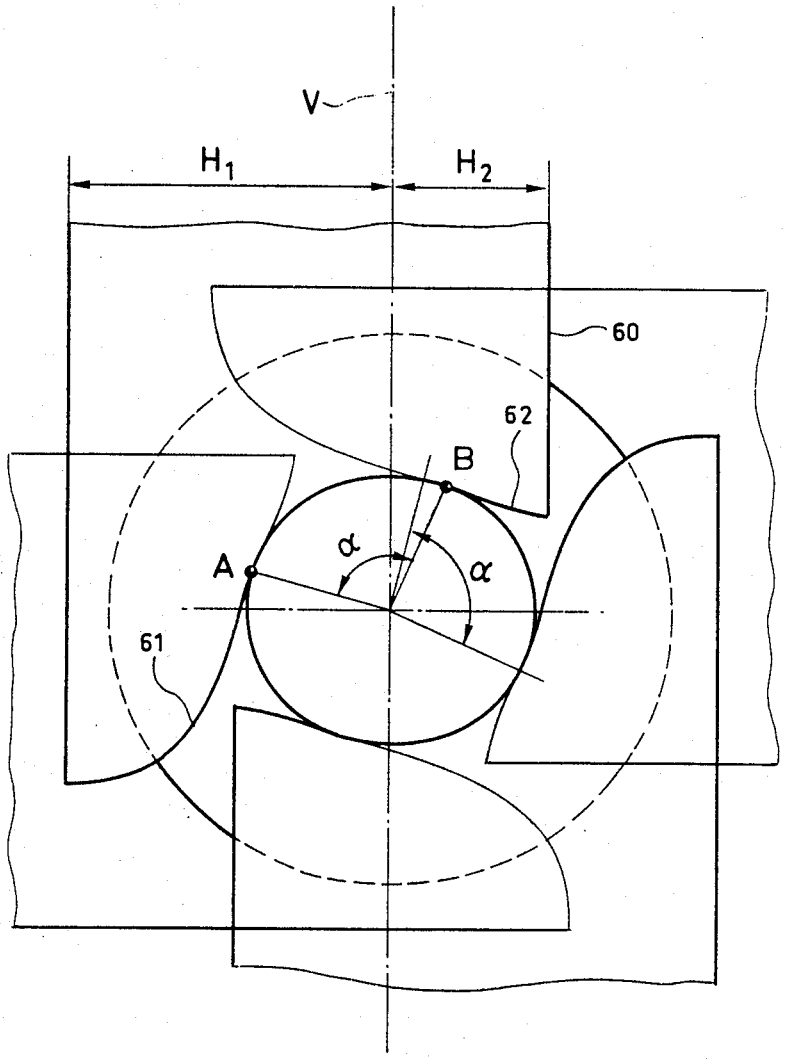
FIG. 6 is a detailed view of the work roll implemented in the embodiment according to FIGS. 5*a*, 5*b*, 5*c* and 5*d*.

FIG. 6 shows in detail the shape of the work rolls which, according to one of the characteristics of the invention, exhibits an asymmetry with respect to plane V, passing through the axis of the rolled bar and perpendicular to the axis of the work rolls. This plane V splits each roller into two portions of uneven heights, e.g., $H_1$ and $H_2$ for work roll 60. The contacting section AB, which coincides in this case with the circularly shaped rounded "waist", is to extend over an angle greater than 90° so as to provide the needed overlap between the successive contact contours of the various opposing paired work rolls, and preferably present an angular offset with respect to center line V so as to promote continuity of the deformation adjacent its ends A and B owing to the outward spreadings 61 and 62, whereby the work roll sides extend beyond A and B.

Figure 7:
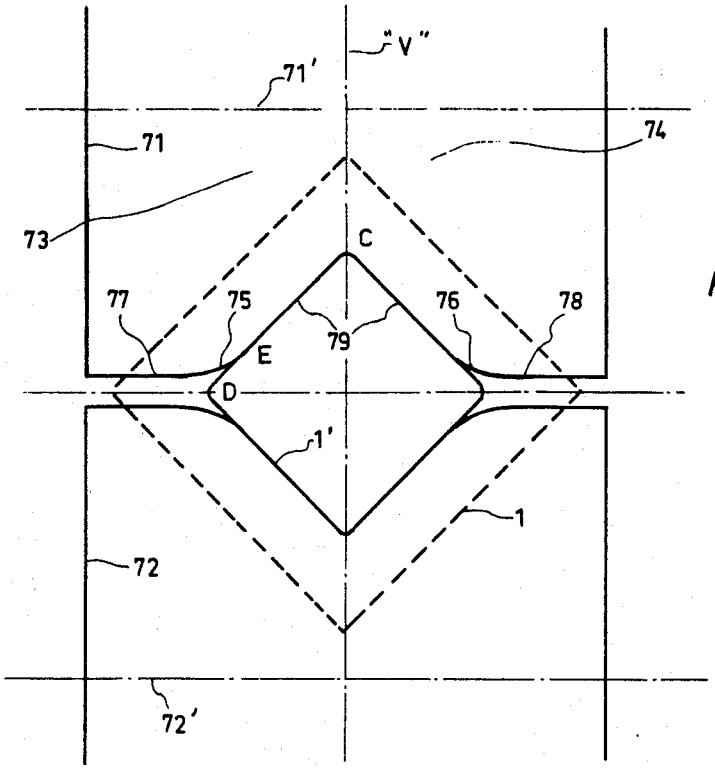
FIGS. 7 and 8 illustrate an embodiment similar to that of FIG. 2, for rolling square billets, but in which the contact between the face of a work roll and the relevent side of the billet cocurs on only a portion of the width of this side.

FIG. 7 illustrates another embodiment of the invention, in which the contact between the two faces of the work roll and the two matching sides of the square billet only takes place on a portion of the width of these sides.

Basically, the invention consists in imparting to each work roll, 71 and 72, rotating about its axis, 71' and 72', the shape of a solid of revolution derived through uniting two co-axial, equal truncated cones 73 and 74, joined by their minor bases so as to form a circular rounded "waist" in the diagonal plane (V) of the billet 1, 1', and perpendicular to the axes 71, 72, of the work rolls. These truncated cones extend beyond their major base by curved surface portions 75 and 76, which merge into the cylindrical portions 77 and 78, each work roll thus having a symmetrical shape with respect to plane V.

Figure 8:
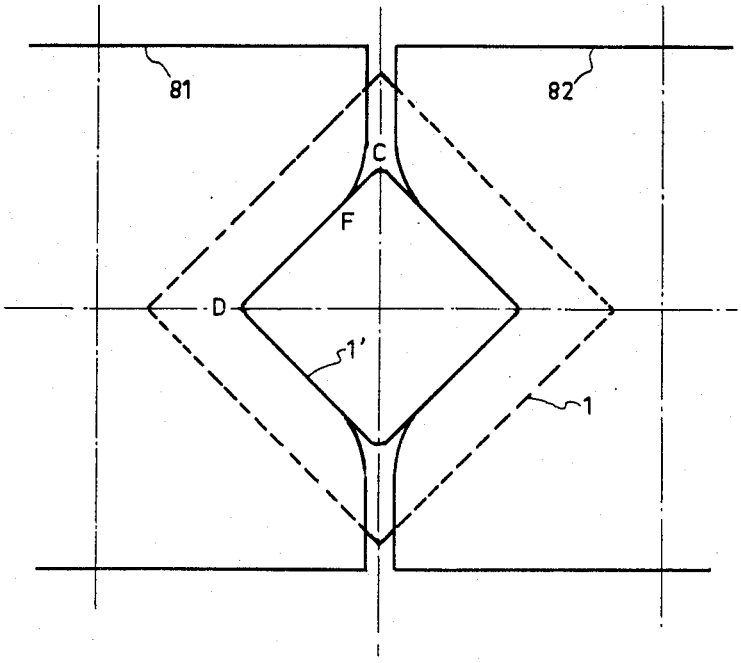

The straight portion 79 of the generatrix or contour of each cone, sloping at 45° to the work roll axis, extends beyond the middle of the side of billet 1', so that there is an overlap between the portion of the billet side in contact with work roll 71 (for instance) during the time the paired work rolls 71, 72 run through the roll-gap, and the portion that is in contact with work roll 81 (FIG. 8) of the opposing paired work rolls which is integral with the other set of work rolls fitted into the two other rotating carriers which immediately thereafter runs through the roll gap.

Thus, in this embodiment, all the work rolls of all four rotating carriers have the same shape, so that, conversely to the first embodiment, the number of work rolls mounted on each rotating carrier is not necessarily even. Although applicable to rolling of materials of any cross-section, the embodiments therefore differ by the shape of the work rolls, their distribution and layout along the periphery of the rotating carriers which support them, and also by the nature and symmetry of the contacts between the work rolls and the billet in the roll gap where the shaping action takes place.

Thus, if one considers the shape taken by the part of the billet in the roll gap, there is a difference between the two embodiments.

In the first embodiment, two of the opposite faces of the billet, for instance, face a, b, f, e, and d, c, g, h (according to FIG. 1*a*) have been in contact throughout their width with the work rolls which have just run through the roll gap, at least through the portion thereof which is adjacent to the exit plane P', whereas the two other faces, a, d, h, e, and b, c, g, f, have been in contact with the same work rolls on only a portion of their width, so that a cross-section of the rolled bar taken in the roll gap exhibits, according to FIG. 9, an approximately square shape of which two opposite sides, respectively, forming part of the faces of the worked material, a, b, f, e, and d, c, g, h, are straight, whereas the two other sides, forming part of faces a, d, h, e, and b, c, g, h, exhibit two distinct portions corresponding, respectively, with the portion of the side which has been in contact with the shorter face of the work roll and the portion of the side which has not been in contact with the work roll, these two portions merging into a slight bulge, 91 (92).

The extent of this bulge depends on the distance (or feed) the billet has moved in the rolling direction between two successive contacts with the successive, opposing paired work rolls which perform the shaping work.

In the second embodiment, no face of the billet is in contact throughout its width with the work rolls which have just run through the roll gap, so that a cross-section of the rolled bar taken in the roll gap takes on the shape illustrated in FIGS. 10 and 11, which show that each of its sides comprises two slightly concave parts, usually of unequal extent, merging with a sort of slightly flared rib (101, 102, 103 and 104) which runs approximately longitudinally, starting where the billet first comes in contact with the work rolls and completely vanishing before the exit plane, so that the billet processed after passing through the universal planetary rolling mill exhibits suitably flat faces.

The characteristic of both embodiments of the invention may be summarized as follows:

(1) an asymmetrical shape of the work rolls;

(2) a greater maximum diameter of the roller, all other conditions being the same (as in the second embodiment), because the longer face extends beyond the diagonal of the billet which is parallel to the axis of the work rolls;

(3) the need to have an even number of paired work rolls per rotating carrier for working equally the four sides of the billet as well as to correct any tendency of the latter to twist;

(4) achieving shaping conditions that will result in a worked material exhibiting within the roll gap a cross-section presenting two opposite, thoroughly smooth faces, whereas the two other faces exhibit only a slight bulge.

The following features characterize the second embodiment:

(1) all work rolls have the same symmetrical shape;

(2) the maximum diameter of the roller is smaller, all other things being equal, than in the first embodiment;

(3) the number of work rolls per rotating carrier is not necessarily even;

(4) the worked material presents within the roll gap on part of its length and on each face, a slightly flared rib running in an approximately longitudinal direction, and which vanishes before the exit plane, so that the sides of the billet after passing through the planetary rolling mill are similar to those derived by rolling according to conventional methods.

These specific charcteristics make it possible to select from the two embodiments the one which is better suited to the application being considered, according to the desired elongation, the required feed, the space requirements for the system and the workability of the rolled metal.

I claim:

1. A rolling mill of universal planetary type for rolling long products of circular cross section, in which a rolling action is performed by work rolls acting as opposing paired work rolls arranged equiangularly at the periphery of rotating rolling units distributed symmetrically about the product to be rolled, wherein:

(a) the axes of said work rolls are parallel with the axis of the rotating rolling unit which bears them;

(b) each work roll is a solid of revolution having two truncated cones with equal minor bases joined together axially forming a waist of circular shape extending over an arc of a circle greater than 90° having its center equidistant from the two axes of said opposing paired work rolls when the latter are performing the rolling action on a said product, said waist having an axis of symmetry other than the plane containing the longitudinal axis of the rolled product and perpendicular to the axis of said work rolls; and said waist spreads outwardly at both ends, thereby providing a continuous transition between the portion of the surface of the rolled product in contact with said work roll and the portion of said surface which is not in such contact.

2. A rolling mill according to claim 1, wherein the respective shapes of the two generatrices making up the faces of both work rolls making up an opposing pair of work rolls, that is, respectively forming part of two opposite rotating rolling units, are oriented with respect to one another by a rotation through 180° about the axis of the material to be rolled, said two generatrices forming the faces of two successive work rolls of the same rotating rolling unit being symmetrical with respect to the plane passing through the center line of the material to be rolled and perpendicular to the axis of said rolling unit.

* * * * *